US006145448A

United States Patent [19]

Marschand et al.

[11] Patent Number: 6,145,448

[45] Date of Patent: Nov. 14, 2000

[54] FURNITURE ARRANGEMENT HAVING A SLIDABLE INTERMEDIATE TABLE

[75] Inventors: Bret Marschand, Grand Rapids; Tim Fookes, Grandville; Bryan Roels, Hamilton; Jeff Tayler, Grand Haven; Linda E. Chesser; William F. Schacht, both of East Grand Rapids, all of Mich.

[73] Assignee: Haworth, Inc., Holland, Mich.

[21] Appl. No.: 09/302,385

[22] Filed: Apr. 30, 1999

[51] Int. Cl.[7] ..... A47B 11/00

[52] U.S. Cl. ..... 108/102; 108/92

[58] Field of Search ..... 108/83, 92, 93, 108/94, 104, 140, 185, 59, 64, 65, 86

[56] References Cited

U.S. PATENT DOCUMENTS

| | | | |
|---|---|---|---|
| 138,406 | 4/1873 | Johnson . | |
| D. 284,336 | 6/1986 | Berry, Jr. . | |
| D. 284,339 | 6/1986 | Berry, Jr. . | |
| D. 292,250 | 10/1987 | Finkelstein . | |
| D. 295,810 | 5/1988 | Saporiti . | |
| D. 330,644 | 11/1992 | Bellini et al. . | |
| D. 349,416 | 8/1994 | Shimogori . | |
| 1,349,710 | 8/1920 | Beeson . | |
| 1,700,201 | 1/1929 | Langford et al. . | |
| 2,240,551 | 5/1941 | Cooper | 108/86 |
| 2,287,626 | 6/1942 | Luebke, Jr. | 108/93 |
| 2,532,041 | 11/1950 | Thompson . | |
| 2,573,496 | 10/1951 | La Verne Runkle . | |
| 2,580,032 | 12/1951 | Lindelof . | |
| 2,605,153 | 7/1952 | Lietz . | |
| 2,705,179 | 3/1955 | Hodgin . | |
| 2,792,226 | 5/1957 | Champion . | |
| 2,943,902 | 7/1960 | McMechen . | |
| 2,988,413 | 6/1961 | Bergen . | |
| 3,002,787 | 10/1961 | Ziegenfuss . | |
| 3,538,862 | 11/1970 | Patriarca . | |
| 4,043,276 | 8/1977 | Dahi | 108/94 |
| 4,223,613 | 9/1980 | Yoshizawa . | |
| 4,258,963 | 3/1981 | Fusselman et al. . | |
| 5,083,512 | 1/1992 | Newhouse et al. . | |
| 5,341,750 | 8/1994 | Fuchs . | |
| 5,400,719 | 3/1995 | Santapa et al. . | |
| 5,568,775 | 10/1996 | Rizzi et al. . | |
| 5,601,348 | 2/1997 | Minkovski . | |
| 5,632,540 | 5/1997 | Wilcox . | |
| 5,666,887 | 9/1997 | Grabowski et al. . | |
| 5,673,631 | 10/1997 | Guns et al. . | |
| 5,683,154 | 11/1997 | Chang . | |
| 5,743,603 | 4/1998 | Kelley et al. . | |
| 5,842,425 | 12/1998 | Van der Aa . | |

FOREIGN PATENT DOCUMENTS

| | | |
|---|---|---|
| 1 463 176 | 11/1965 | France . |
| 23 49 792 | 4/1975 | Germany . |
| 510286 | 1/1955 | Italy . |
| 659 177 | 1/1987 | Switzerland . |
| 675 816 | 11/1990 | Switzerland . |

*Primary Examiner*—Peter M. Cuomo
*Assistant Examiner*—Jerry Anderson
*Attorney, Agent, or Firm*—Flynn, Thiel, Boutell & Tanis, P.C.

[57] ABSTRACT

A desk arrangement is provided which includes freestanding furniture units, namely, a stationary cabinet and a movable table. While the movable table is movable relative to the cabinet, the cabinet and table are connected together by an intermediate link top which permits relative movement therebetween but interconnects the cabinet and table to define a single interconnected furniture unit. The link top is both slidable and pivotable relative to the cabinet and table to permit sliding and pivoting of the table between a closed position directly adjacent to the cabinet and an open position spaced outwardly therefrom. The link top can define an auxiliary worksurface and also defines a bridge between the cabinet and table to which cabling can be connected. This arrangement thereby permits flexible repositioning of the table while also permitting power and/or communications cabling to be routed therebetween.

20 Claims, 11 Drawing Sheets

FURNITURE ARRANGEMENT HAVING A SLIDABLE INTERMEDIATE TABLE

FIELD OF THE INVENTION

The invention relates to a desk arrangement having a cabinet and a table which can be readily repositioned for use and more particularly, to an improved desk arrangement wherein the cabinet and table are interconnected together by an intermediate link top.

BACKGROUND OF THE INVENTION

In office areas, a table or desk typically is provided on which an occupant works while additional storage cabinets, hutches and file cabinets are provided for storage. These components often are provided separately and grouped as desired into various configurations.

In addition to these furniture components, in most cases it also is necessary to provide power and/or communications cabling to the work area in order to support office components such as computers, printers, modems, lighting and the like. For stationary components such as cabinets and hutches and conventional wall panel arrangements on which furniture components can be directly supported, cabling can be readily routed and supplied to these areas.

However, for movable components particularly for tables and other movable worksurfaces, it is more difficult to provide access to power and/or communication cabling since the position of the furniture component is varied which may therefore interfere with cabling.

In typical arrangements, receptacles may be provided in the floor, walls, free standing pedestals or other suitable locations to provide receptacles adjacent to the movable tables so that a user can connect their equipment thereto. However, these arrangements can be less than desirable since the receptacles and the cabling connected thereto can be exposed and therefore unsightly, or the cables may interfere with movement of the table relative to the receptacles.

The present invention as disclosed herein relates to an improved desk arrangement that overcomes a number of disadvantages associated with known desk arrangements.

More particularly, the desk arrangement of the invention includes a freestanding stationary unit such as a desk, cabinet or hutch, in combination with a freestanding movable unit that typically is a table. The improved desk arrangement also includes an intermediate link top, which extends between and is pivotally connected to the stationary unit and the table. The intermediate link top is pivotally and slidably connected to the desk unit and table to provide various combinations of pivoting and sliding at the opposite ends thereof. As a result, these connections permit the table to being moved away from the desk to an open position and allow the table to be pivoted or swung to a new position for use.

The intermediate link top serves to maintain a connection between the desk unit and the movable tabletop such that the desk and table are continually interconnected to each other. As a result, this arrangement permits cabling to be supported on the intermediate link top wherein the cabling extends between the desk unit and the tabletop. As a result, receptacles can be mounted to the tabletop which provides direct access to receptacles at the table even when the table is moved. Thus, this eliminates cables which hang between the worksurface and floor or to fixed receptacle locations which otherwise limits the ability to move the table.

Still further, the table may be moved adjacent to the desk unit effectively in a closed position such that the table and desk can be used as a single unit having a continuous coplanar worksurface area extending therebetween. When the table is moved to the closed position, the intermediate link top slides and pivots to a stored position under the worksurfaces of the desk unit and table. When the table is in the open position, the intermediate link top also may be used as an auxiliary worksurface.

With this arrangement, electrical and/or power receptacles can be readily provided directly on the table without interfering with movement and repositioning of the table. The increased movability and cabling capacity greatly increases the flexibility of an office area in which the inventive desk arrangement is used.

Other objects and purposes of the invention, and variations thereof, will be apparent upon reading the following specification and inspecting the accompanying drawings.

Figure 1:
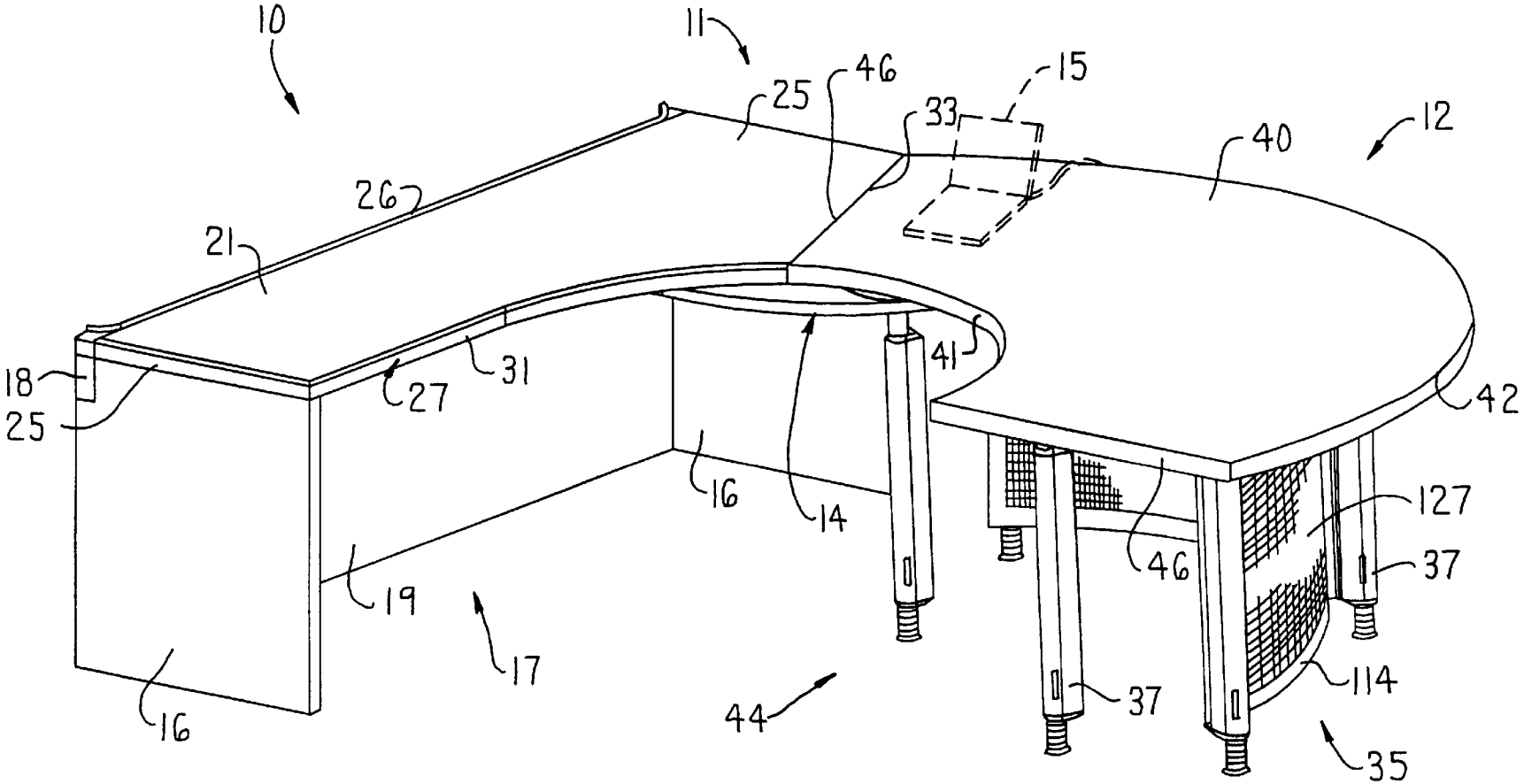
FIG. 1 is a perspective view of a desk arrangement of the invention illustrating a desk and table in a closed position.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Figure 2:
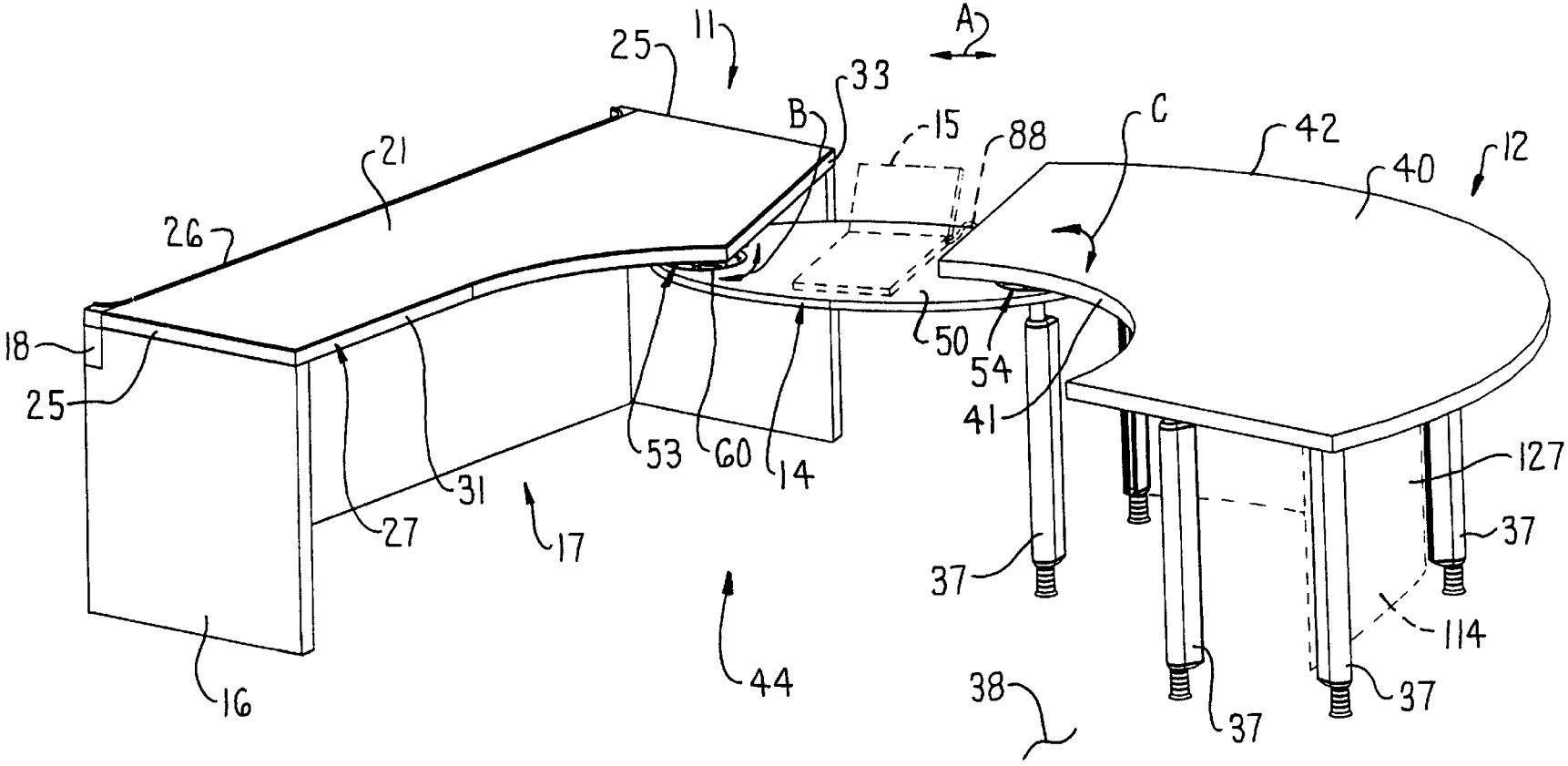
FIG. 2 is a perspective view of the desk arrangement in an open position having an intermediate link top extending between the desk and table.

Referring to FIGS. 1 and 2, a desk arrangement 10 of the invention is illustrated. The desk arrangement 10 includes a pair of freestanding units, namely, a first desk unit 11 which is formed as a stationary desk and a second desk unit 12 which is formed as a movable table. The desk 11 and table 12 are interconnected together by an intermediate table top or link top 14 wherein these components are slidably and/or pivotally connected together to permit relative movement between the desk 11 and table 12.

In use, the desk 11 and table 12 can be pushed together to a closed position as illustrated in FIG. 1, and pulled apart to the open position as illustrated in FIG. 2. Interconnection of the desk 11 and table 12 by the link top 14 provides significant flexibility in arranging an office since the desk 11 and table 12 are movable toward and away from each other as indicated generally by reference arrow A, and are pivotable or swingable relative to each other as indicated generally by reference arrows B and C. As the freestanding components move, the link top 14 moves therewith. Besides the increased reconfigurability provided by the desk arrangement 10, this arrangement also has a an increased cabling capacity to facilitate the use of electrical equipment such as a laptop computer 15 or other office equipment as will be discussed herein.

More particularly, the desk 11 in the illustrated embodiment is a freestanding stationary unit although it is also possible to form the desk 11 so that it is readily movable if this is desired for a particular office arrangement. It is also understood that while the desk arrangement 10 is illustrated as including a desk and table, the link top 14 may also be used to interconnect other furniture components such as cabinets or the like together.

Referring to FIGS. 1 and 2, the desk 11 includes upstanding end panels 16 which are laterally spaced apart to define a knee space 17 therebetween. Each of the end panels 16 includes an access opening 18 at a rear corner to permit routing of power and/or communication cabling to the area proximate the knee space 17 which cabling may thereafter be routed to adjacent furniture components and also be routed horizontally to the table 12 or vertically to the top of the desk 11.

Figure 3:
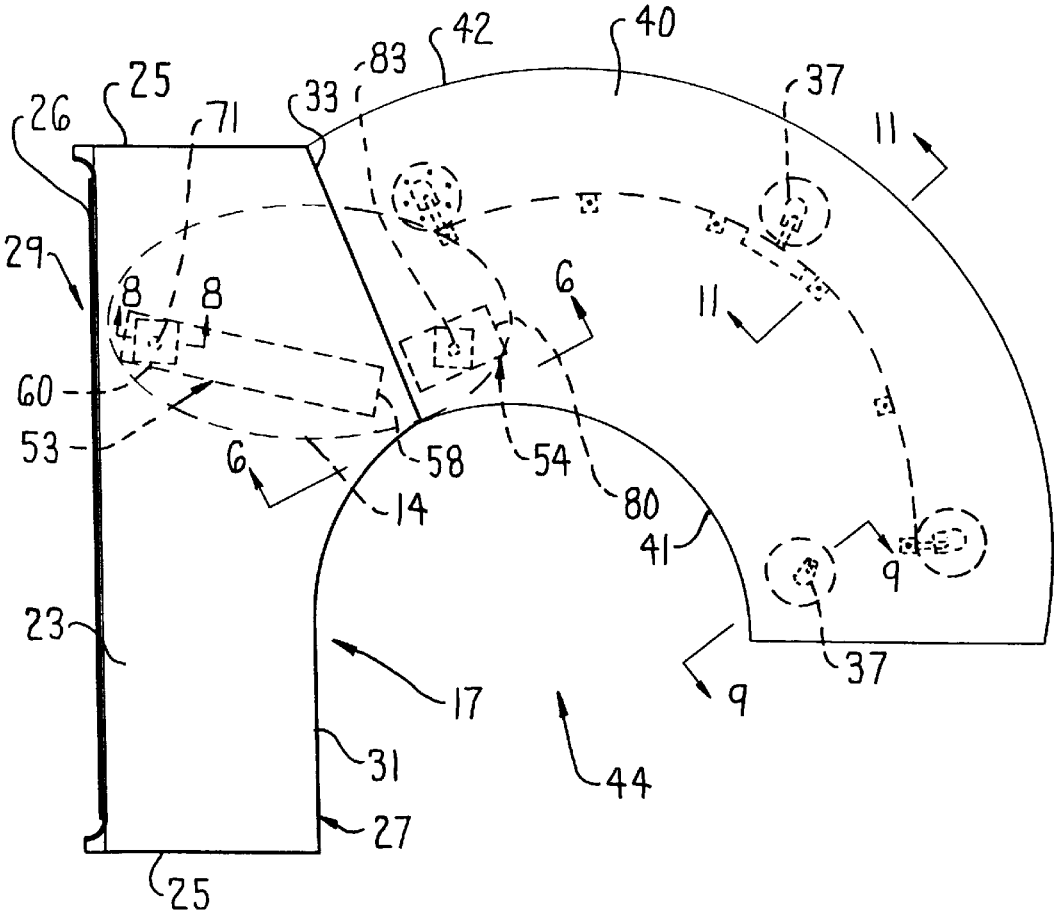
FIG. 3 is a top view of the closed desk arrangement of FIG. 1.

A laterally elongate modesty panel 19 extends between and is connected to the end panels 16 such that the end panels 16 and modesty panel 19 define a support structure upon which a laterally elongate worksurface 21 is supported. While the worksurface 21 may be formed with a wide variety of shapes and sizes, the illustrated embodiment as seen in FIG. 3 has a non-rectangular shape which cooperates with the table 12 to define a generally arcuate worksurface area 23 which extends continuously between the desk 11 and table 12 and partially surrounds an occupant.

The desk worksurface 21 includes end edges 25, a back edge 26 and a front edge 27 that define the periphery thereof. Referring to FIGS. 1–4, the back edge 26 defines a cable management slot 29 which permits cabling to be routed from underneath the worksurface 21 to the top thereof even when the desk 11 is pushed against a wall surface.

On the opposite side of the desk 11, the front edge 27 includes an arcuate edge section 31 that extends generally laterally and is disposed directly adjacent to the occupant. The front edge 27 also includes a further edge section 33 which defines an extension of the arcuate edge section 31 but is oriented at an angle relative thereto. The edge section 33 is disposed directly above the link top 14 and is adapted to mate with or abut against the table 12 as discussed herein.

Figure 4:
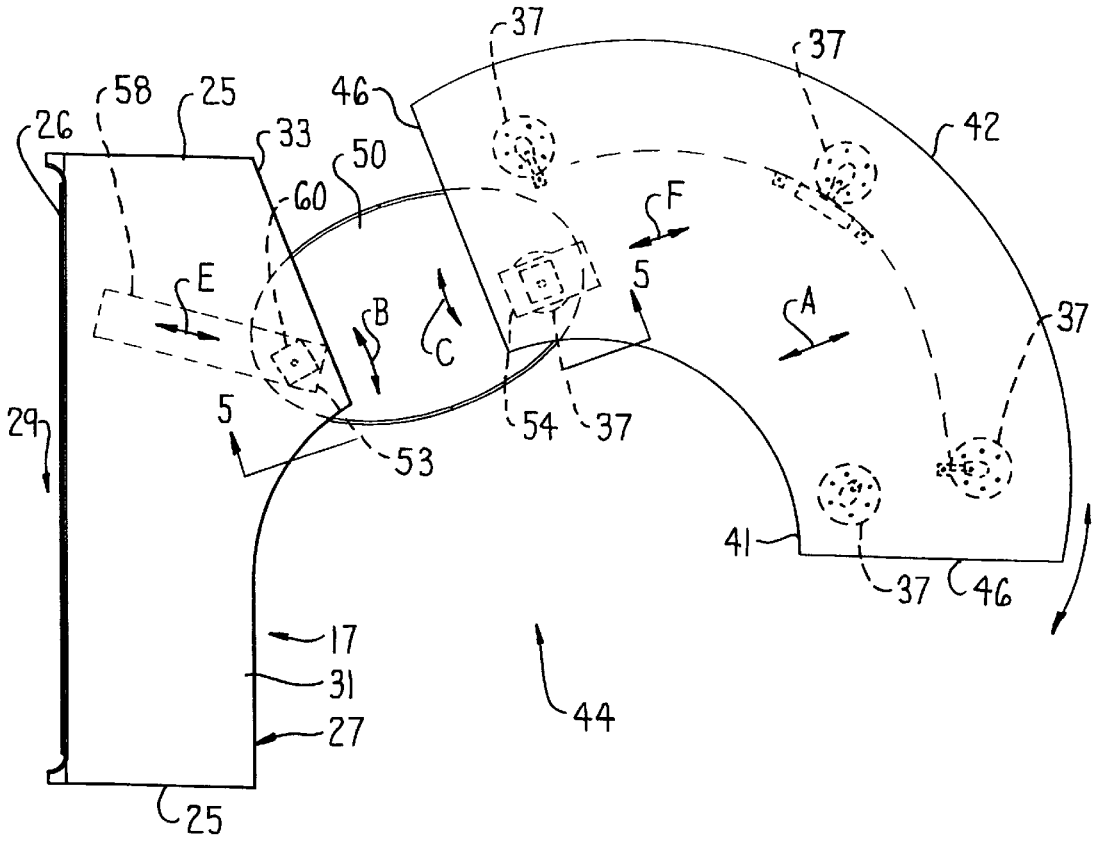
FIG. 4 is a top view of the open desk arrangement of FIG. 2.

With respect to the table 12, the table 12 includes freestanding support structure 35 which in the illustrated embodiment comprises a plurality of vertically elongate support legs 37 which are disposed in load bearing relation with the floor 38. The upper ends of the support legs 37 support a horizontally enlarged worksurface 40. Similar to the worksurface 21, the worksurface 40 may be formed of a variety of shapes and sizes, although in the illustrated embodiment as seen in FIGS. 3 and 4 the worksurface 40 has a generally arcuate shape.

The arcuate shape of the worksurface 40 is defined by curved inner and outer edges 41 and 42 wherein the inner edge 41 has a radius of curvature which corresponds with the adjacent portion of the arcuate edge section 31 on the worksurface 21. Accordingly, a continuous curved edge is defined adjacent to and in partially surrounding relation to a seating area 44 in which an occupant typically works when the desk arrangement is closed. When in the closed position of FIG. 3, the worksurface 40 generally extends in a longitudinal direction which is transverse to a longitudinal direction of the adjacent worksurface 21 of the desk 11.

The opposite ends of the worksurface 40 are defined by end edges 46. The end edge 46 disposed adjacent to the worksurface 21 moves toward and away from the worksurface 21 and is adapted to abut against or mate with the opposing edge section 33.

In particular, the edge section 33 and the adjacent end edge 46 of the table 12 each have a shape that is complementary to the other. While these complementary edges 33 and 46 are linear, these edges 33 and 46 may also have a non-linear shape. As a result, when the worksurface 40 is disposed against the worksurface 21 in the closed position of FIG. 3, the worksurface area 23 extends substantially continuous through this region preferably with little if any gaps being formed between the edge section 33 and edge 46. The desk 11 and table 12 therefore are usable independently of each other when separated in the open position of FIG. 4, while also being usable as a single unit when in the closed position of FIG. 3.

While the desk 11 and table 12 are movable relative to each other, these components also are interconnected together by the link top 14 so as to prevent complete separation thereof. Besides interconnecting the desk 11 and table 12 together, the link top 14 also provides a support structure for supporting cabling which extends from the desk 11 to the table 12 for electrical equipment disposed on the table 12 or the link top 14.

Figure 12:
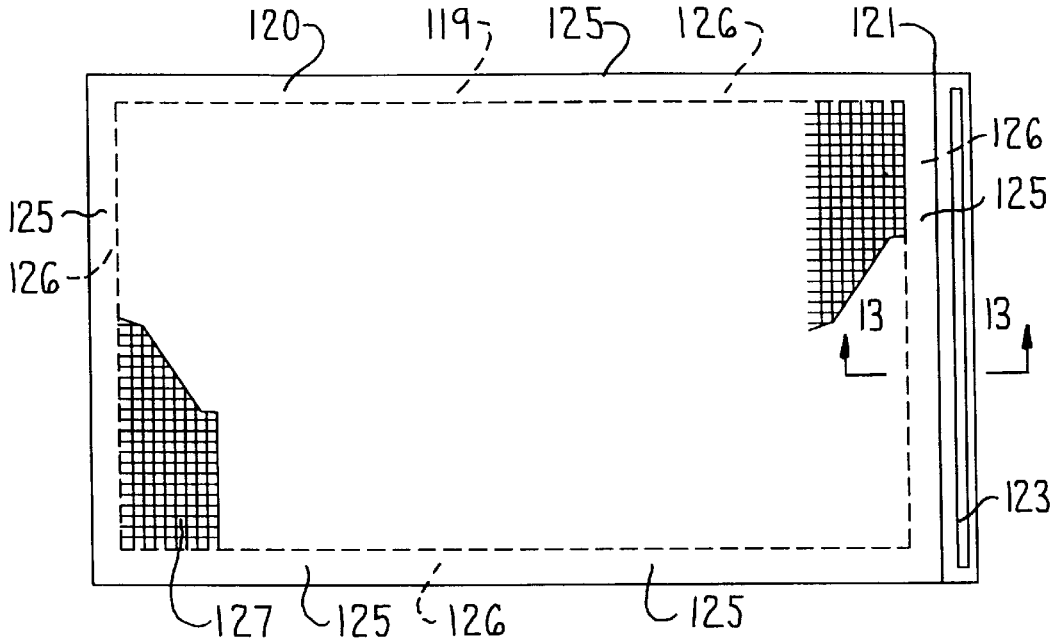
FIG. 12 is a front elevational view of a privacy screen for the table of FIG. 1.

More particularly, the link top 14 has a generally oval shape as illustrated in FIGS. 3 and 4 and defines an intermediate worksurface 50. The link top 14 is exposed when the desk 11 and table 12 are spaced apart in the open position such that the intermediate worksurface 50 is accessible in the region between the worksurface 21 and worksurface 40. This intermediate worksurface 50 may be used as an auxiliary storage or writing area or can be used to support electrical components such as a laptop computer 15 illustrated diagrammatically in phantom outline in FIG. 12. When the desk arrangement 10 is in the closed position of FIGS. 1 and 3, the link top 14 is stored below and completely covered by the worksurfaces 21 and 40 such that the computer 15 would be moved to the worksurfaces 21 and 40.

To connect the opposite ends of the link top 14 to the desk worksurface 21 and table worksurface 40 respectively, the link top 14 includes a desk connector 53 and table connector 54 at the opposite ends thereof. The desk connector 53 and table connector 54 are mounted on the top of the link top 14 and fastened to the bottom of the work surfaces 21 and 40 such that the link top 14 generally is suspended between and below the work surfaces 21 and 40. The desk connector 53 and table connector 54 are functionally the same as each other in that they both permit relative sliding and pivoting movement between the link top 14 and the respective desk 11 and table 12.

Figure 6:
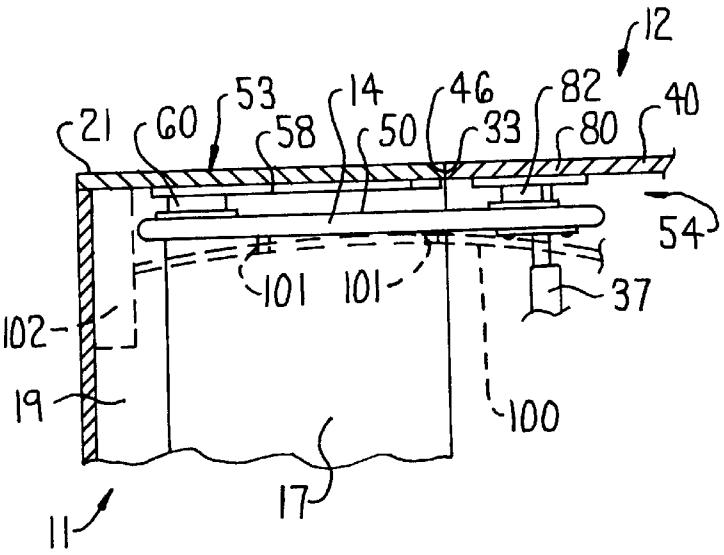
FIG. 6 is a front elevational view in cross-section of the closed desk arrangement as taken along line 6—6 of FIG. 3.
Figure 5:
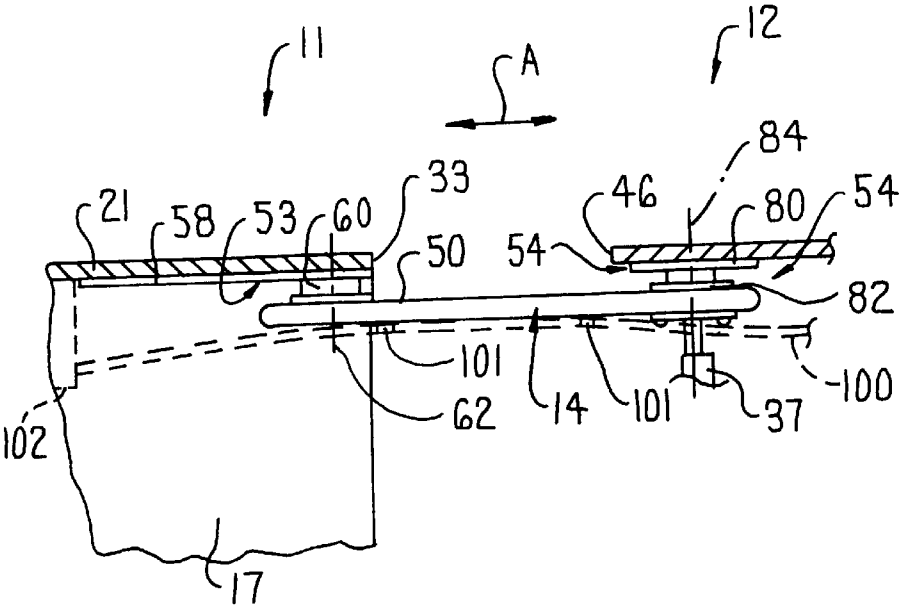
FIG. 5 is a front elevational view in cross-section of the open desk arrangement as taken along line 5—5 of FIG. 4.

In particular, the sliding and pivot connections permit the link top 14 to be slid underneath and stored below the work surfaces 21 and 40 as illustrated in FIG. 6, and also permit the link top 14 to be extended to the use position as illustrated in FIG. 5. In the use position, the link top 14 itself may pivot or swing sidewardly relative to the desk 11 while the table 12 itself can pivot or swing sidewardly relative to the link top 14. This articulating connection between the desk 11 and table 12 permits the table 12 to be repositioned in any of a number of positions.

Referring to FIGS. 4, 5, 7 and 8, the desk connector 53 generally comprises an axially elongate track 58 which is supported on the underside of the worksurface 21, a slide 59 (FIGS. 7 and 8) which is slidable axially along the longitudinal length of the track 58, and a pivotable mounting bracket 60 which is pivotally connected to the slide 59 and to the link top 14. With this arrangement, the inner end of link top 14 is slidable axially along the length of the track 58 along the slide path identified by reference arrow E (FIG. 4). The inner end of the link top 14 also is pivotable relative to the worksurface 21 about vertical pivot axis 62 which therefore allows the link top 14 to be positioned generally at an angle underneath the worksurface 21 as seen in FIG. 3.

More particularly, the track 58 preferably is oriented transversely at an angle relative to the edge section 33 such that the inner end of the link top 14 slides inwardly towards the modesty panel 19 and longitudinally towards the end wall 25 so that the link top 14 moves generally toward the corner of the desk 11. As a result, the inner end of the link top 14 is pulled or guided away from the edge sections 31 and 41 of the work surfaces 21 and 40 respectively. By utilizing this larger storage area in the corner of the desk 11, the length of the link top 14 can be increased without interfering with the modesty panel 19. It also is possible to increase the angle between the track 58 and the modesty panel 19 so that the link top 14 is pulled farther into the corner.

Figure 7:
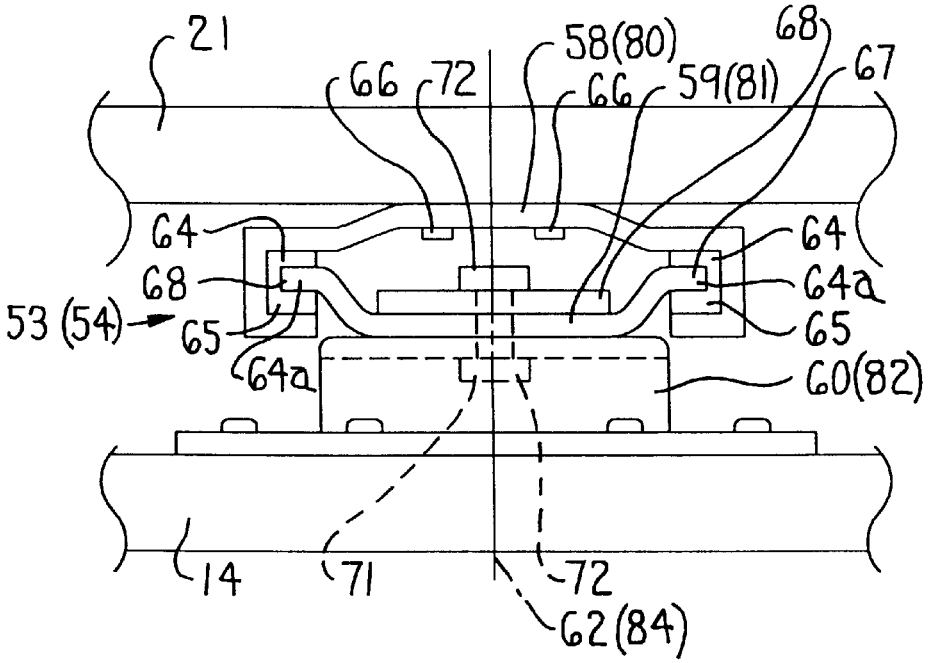
FIG. 7 is a side elevational view of a slide mechanism for the intermediate link top.
Figure 8:
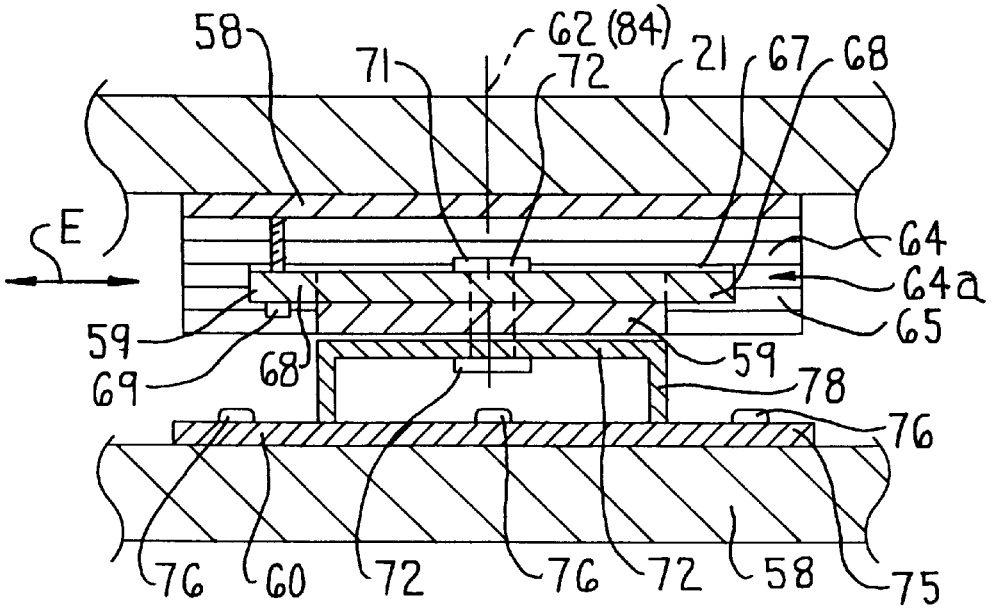
FIG. 8 is a cross-sectional view of the slide mechanism as taken along line 8—8 of FIG. 3.

More particularly with respect to the desk connector 53, FIGS. 7 and 8 illustrate the preferred arrangement thereof. With respect to the track 58, the track 58 defines a pair of horizontally elongate guide slots or channel 64 along the opposite side edges thereof. Each track 58 includes an elastomeric C-shaped bushing 65 which is slid sidewardly into the respective channel 64 and is adapted to slidably engage the slide 59. The track 58 is fastened to the worksurface 21 by suitable fasteners 66.

The slide 59 is a horizontally elongate plate which defines edge flanges 67 along the opposite side edges thereof. The edge flanges 67 are slidably received within sidewardly opening channels 64*a* of the bushings 64 such that the slide 59 can slide horizontally along the slide path (reference arrow E in FIGS. 4 and 8) which is defined by the longitudinal length of the track 58.

The slide 59 further includes a rigid strengthening plate 68 secured to the top surface thereof to provide rigidity to the slide 59. At least one end of the strengthening plate 68 projects axially beyond an end edge of the slide 59 to permit locking of the slide 59 relative to the track 58. In particular, the projecting end of the strengthening plate 68 includes thumb screws 69 which define locking means. The thumb screws 69 extend vertically upwardly and can be tightened to press against a lower surface of the track 58 to prevent horizontal sliding of the slide member 59.

To support the link top 14 on the slide 59, a pivot pin 71 projects vertically through the strengthening plate 68 of the slide 59 into pivoting engagement with an upper wall 72 of the mounting bracket 60. More particularly, the pivot pin 71 includes enlarged heads 72 at the opposite ends thereof which vertically connect the mounting bracket 60 and the slide 59 together while permitting relative pivoting movement therebetween about pivot axis 62 that is defined by the vertical axis of the pivot pin 71.

With respect to the mounting bracket 60, the mounting bracket 60 includes a circular mounting plate 75 which is fastened to an upper surface of the link top 14 by suitable fasteners 76. A generally U-shaped housing 78 is secured to the top surface of the mounting plate 75, and is pivotally secured to the bottom of the pivot pin 71. With this arrangement, the inner end of the link top 14 is able to both slide and pivot relative to the desk worksurface 21.

With respect to the table connector 54, this unit is formed substantially identical to the desk connector 53. In particular, the table connector 54 includes a track 80, slide 81 and mounting bracket 82 wherein the slide 81 and mounting bracket 82 are connected together by a pivot pin 83 (FIG. 3) which defines a pivot axis 84 (FIG. 5). The cooperation of the track 80 and slide 81 defines a slide path F along which the outer end of the link top 14 can move. The only difference between the table connector 54 and desk connector 53 of the illustrated embodiment is that the length of the track 80 is shorter than the length of the track 58 as seen in FIG. 3. Other than this difference, the table connector 54 permits sliding and pivoting movement of the link top 14 relative to the worksurface 40 of the table 12, and can be locked to prevent further sliding.

In a preferred embodiment, both the desk connector 53 and table connector 54 permit sliding and pivoting movement. It is understood that different combinations of sliding and pivoting movement are permitted. For example, the table connector 54 may only permit pivoting movement where there is sufficient storage area underneath the worksurface 21 and worksurface 40 to store a greater portion of the link top 14 therein. In fact, this is permitted in the illustrated arrangement since either of the connectors 53 and 54 can be locked to prevent sliding. Further, the angle of the tracks 58 and 80 may also be varied to vary the paths along which the opposite ends of the link top 14 travel to thereby vary the storage position and the use position for the like top 14 depending upon the size and configuration of the desk arrangement 10.

Preferably, the work surfaces 21 and 40 are positioned coplanar to each other, while the link top 14 is stored below this plane. As result of this arrangement of work surfaces and the relative movement permitted therebetween, it is possible to close the desk arrangement as generally illustrated in FIGS. 1 and 3 to define a continuous worksurface area 23 which includes both the worksurface 21 and worksurface 40. Further, when the desk arrangement is opened as illustrated in FIGS. 2 and 5, an auxiliary work area is exposed for use, such as for the use of electrical components like the laptop computer 15. Further, this arrangement permits the table 12 to be swung horizontally about the pivot axes 62 and 84 to a desired work position.

Figure 9:
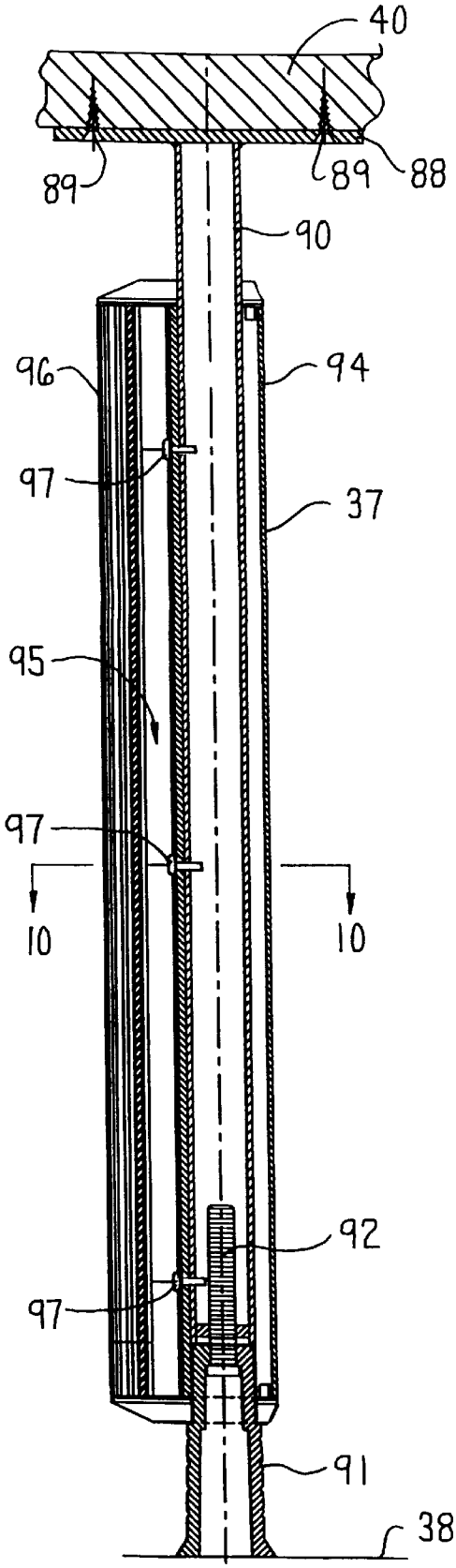
FIG. 9 is a side elevational view in cross-section of a table leg as taken along line 9—9 of FIG. 3.

With respect to the support structure for the table 11, the table legs are illustrated in FIG. 1, and a representative one of the table legs 37 is illustrated in FIG. 9. The table leg 37 includes an upper mounting plate 88 which is secured to the worksurface 40 by fasteners 89. A support tube 90 extends downwardly therefrom, the lower end of which includes a height-adjustable foot 91. The foot 91 includes a threaded shank 92 which can be threaded vertically into and out of the support tube 90.

Figure 10:
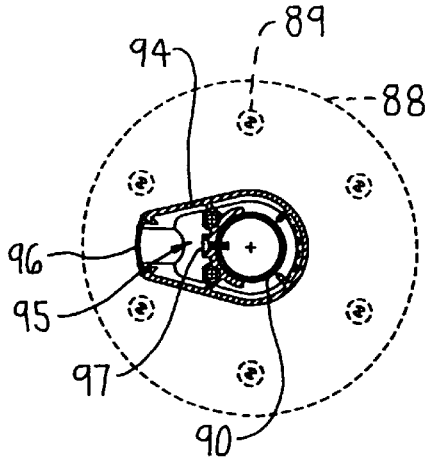
FIG. 10 is a top view in cross-section of the table leg as taken along line 10—10 of FIG. 9.

The support tube 90 is enclosed by an outer shroud 94. The outer shroud 94 has an enlarged left side that defines a vertical cable management channel 95 which permits cabling to be routed vertically through the interior of the support tube 90 between the worksurface 40 and the floor 38. The cable management channel 95 includes a removable cover or door 96 which provides access to the channel 95 as seen in FIG. 10. A plurality of screws 97 also is provided on the interior thereof.

Figure 11:
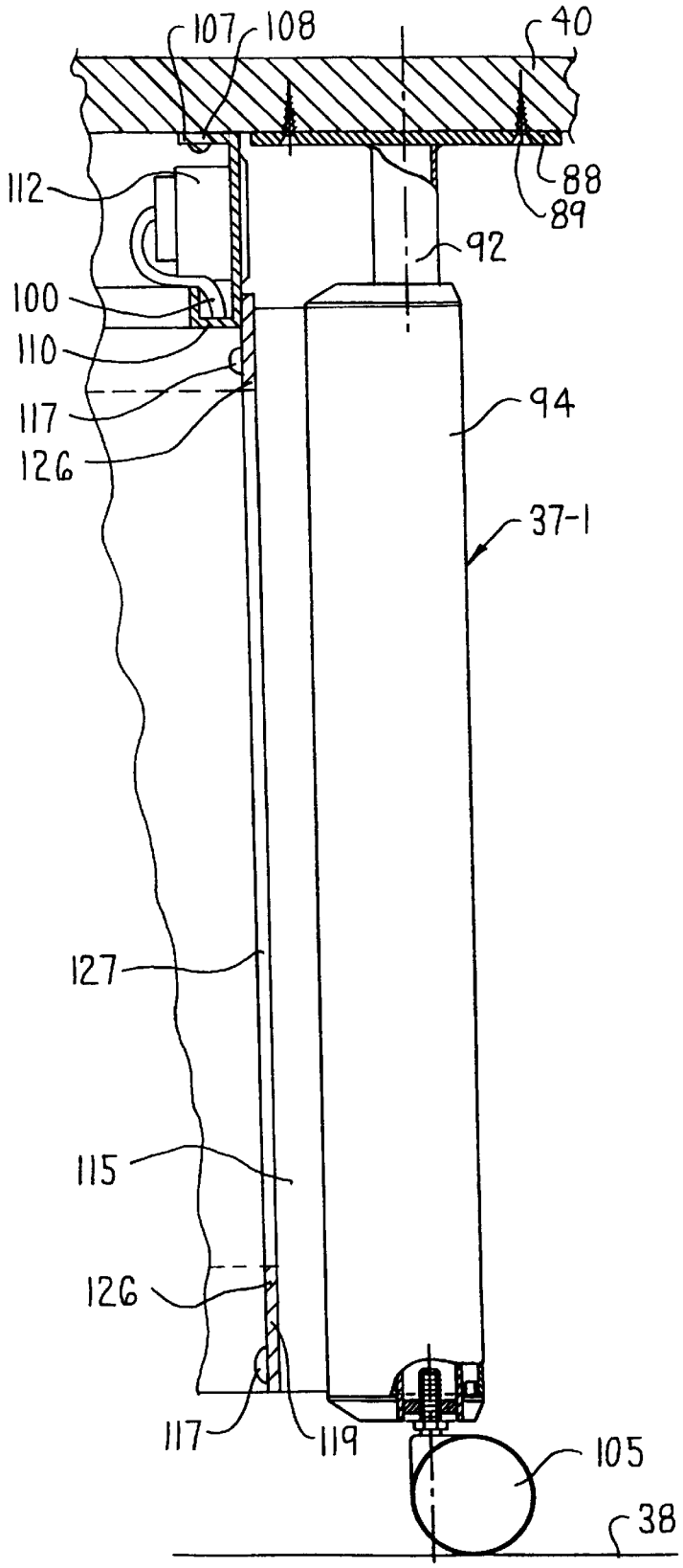
FIG. 11 is a side elevational view in cross-section of a modified table leg as taken along line 11—11 of FIG. 3.

Most of the legs 37 have the same length and are secured to a bottom surface of the worksurface 40 except that one leg 37 has a shorter length and is connected directly to a bottom surface of the link top 14 as can be seen in further detail in FIGS. 5 and 6. Referring to FIG. 11, an alternative leg arrangement 37-1 is illustrated wherein the only difference between the leg 37-1 and the above-described leg 37 is that the leg 37-1 includes a caster 105 on the lower end thereof, which facilitates movement of the table 12.

Besides the ready of reconfigurability of the desk arrangement 10, desk arrangement 10 also is readily able to support cabling thereon such as power and/or communication cabling 100 as illustrated in FIGS. 5 and 6. More particularly, the cabling 100 is supported on a lower surface of the link top 14 by connectors 101 which are formed as straps, clips or the like. The cabling 100 should have sufficient slack at least beneath the desk 11 to permit the link top 14 to be extended and retracted. The desk arrangement 10 also includes a storage compartment 102 on the desk 11 to store excess cabling. Since the cabling 100 is supported and protected by the link top 14, the table 11 can be readily repositioned without damage to the cabling 100 which extends between a stationary desk 11 and table 12.

Referring to FIGS. 3 and 11, the cabling 100 is further supported near the front edge of the table 12 by an arcuate fascia panel 106 which is fastened to the underside of the worksurface 40. In particular, the fascia panel 106 includes circumferentially spaced apart flanges 107 through which screws 108 are threaded into the worksurface 40. The lowermost edge of the fascia panel 106 extends inwardly away from the outermost edge of the worksurface to define a generally C-shaped cable management channel 110 which extends along the longitudinal length of the fascia panel 106 and accessible from an inner side of the fascia panel 106. The channel 110 is adapted to receive cabling 100 therein.

At the circumferential center of the fascia panel 106 near the center leg 37, a receptacle unit 112 is mounted thereto. The receptacle unit 112 opens outwardly through the fascia plate 106 and is connected to the cabling 100. Therefore, electrical equipment can be connected to the receptacle unit 112 by laying the cabling over the outer edge of the worksurface 40.

The table 12 also includes a modesty or privacy panel 114 (FIGS. 1, 3 and 11). The modesty panel 114 has an arcuate shape and is vertically enlarged to generally enclose the area disposed below the table worksurface 40.

To support the modesty panel 114 on the table 12, the three outermost legs 37 include mounting brackets 115 which secure the modesty panel 114 thereto. More particularly, the mounting brackets 115 are vertically elongate and slide into the open side of the channel 95 defined in the leg 37. The mounting brackets 115 are secured in place by the above-described fasteners 97 while the modesty panel 114 itself is fastened on the mounting brackets 115 by fasteners 117. Preferably, the upper edge of the modesty panel 114 overlaps the lower edge of the fascia plate 106 as seen in FIG. 11.

More particularly with respect to the modesty panel 114, the modesty panel 114 includes a generally rectangular open frame 119 which is formed of a plate-like spring steel or other similar, rigid but flexible material. The frame 119 is sufficiently flexible so as to be bent into the arcuate shape when being mounted to the legs 37. The frame 119 also provides rigidity to an outer resilient fabric covering 120 which is fitted over the frame 119.

Figure 13:
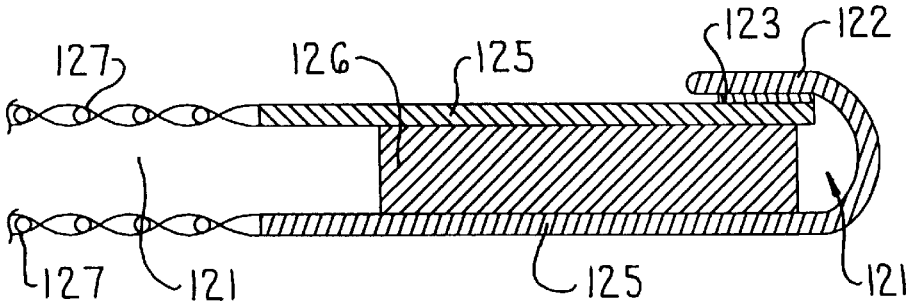
FIG. 13 is a bottom cross-sectional view of an edge of a privacy screen as taken along line 13—13 of FIG. 12.
Figure 14:
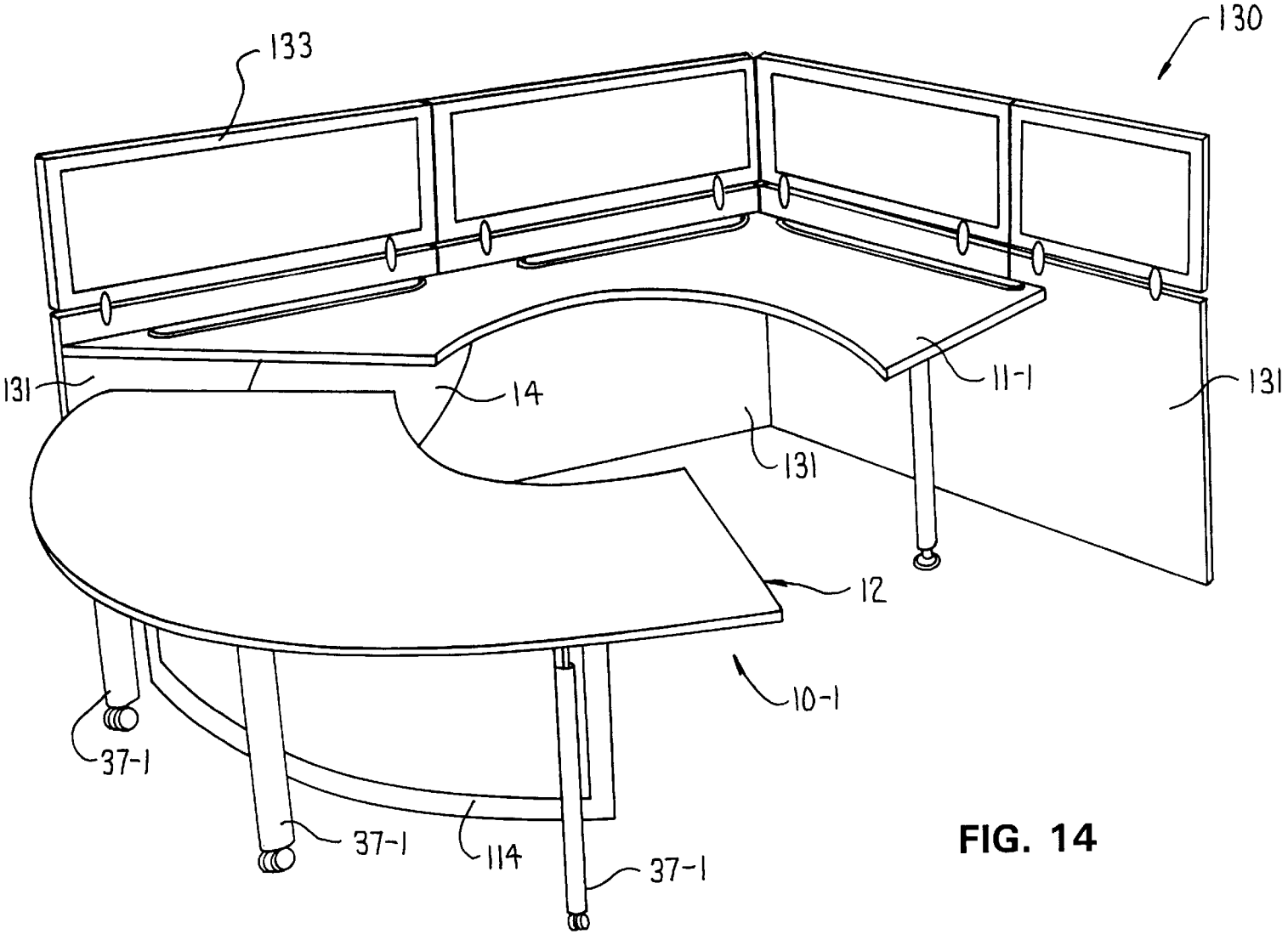
FIG. 14 is a perspective view of an alternative desk arrangement in an open position.
Figure 15:
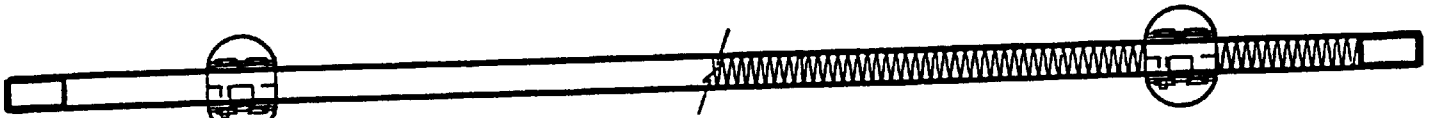
FIG. 15 is a top view of a privacy screen for the desk arrangement of FIG. 14.
Figure 16:
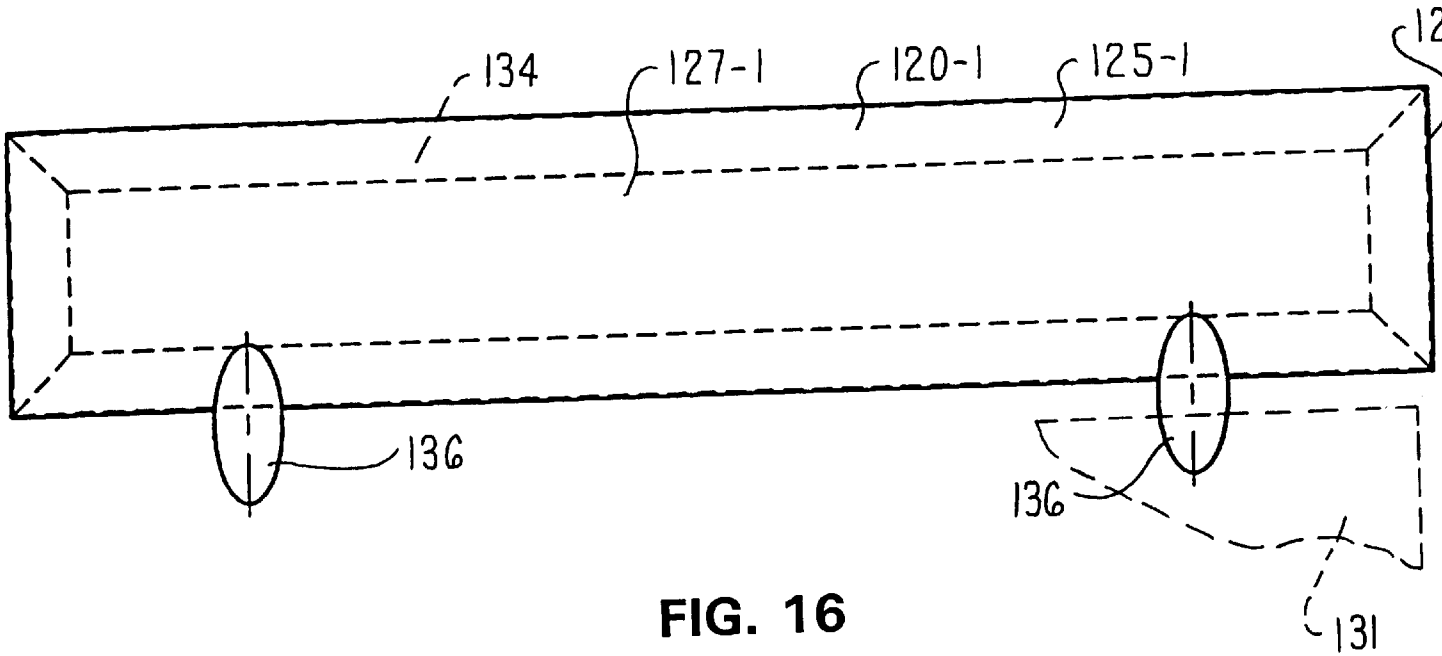
FIG. 16 is a front elevational view of the privacy screen with a wall panel illustrated in phantom outline.
Figure 17:
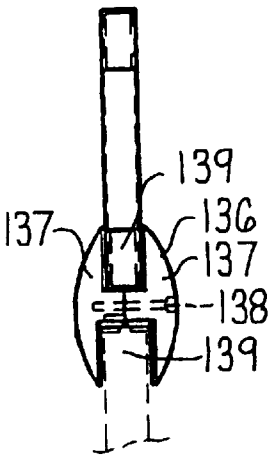
FIG. 17 is an end elevational view of the privacy screen and wall panel of FIG. 16.

The covering 120 is formed of a resilient fabric material, which is formed as a pouch or pocket having a hollow interior compartment 121 (FIGS. 13). The interior compartment 121 has an open edge area and in particular, is open at one end and has a flap-like closure 122 thereon. The interior compartment 121 is adapted to receive the frame 119 tight-fittingly therein wherein the closure 122 is folded over the end of the frame 119 and secured to the outer surface of the covering 120 by a fastener 123 such as Velcro.

To conceal the interior frame 119, the covering 120 includes a solid portion 125 of fabric material extending about the periphery so as to overlie and conceal the frame members 126 of the frame 119. The covering 120 also includes a mesh-like central portion 127 which has an open weave and extends laterally and vertically between the solid portions 125. The central portion 127 also may be formed of the same fabric material as the solid portion if desired. Since the covering 120 is formed of a resilient material, the frame 119 not only provides support to the covering 120 but also provides limited stretching of the covering 119 such that the covering 120 is taught.

Besides providing a modesty panel 114 which is relatively easy to assemble and has a minimum number of component parts, the modesty panel 114 also provides a soft surface adjacent to the legs of the user. Thus, if the user strikes the modesty panel 114, the resilient fabric material flexes or stretches and accommodates the user and is therefore more comfortable.

An alternative construction for a modesty panel is illustrated in FIGS. 14–17. More particularly, a furniture arrangement 130 is illustrated which includes a desk arrangement 10-1 disposed adjacent to an arrangement of conventional space-dividing knee walls 131. More particularly, the desk arrangement 10-1 includes a first desk unit 11-1 and a table 12 wherein the first desk unit 11-1 and table 12 are connected together by the same arrangement of the link top 14 as previously described herein. The desk arrangements 10 and 10-1 are functionally the same and thus, a further discussion with respect to the components of the desk arrangement 10-1 is not necessary.

However, the knee walls 131 include privacy panels 133 which are formed similar to the modesty panels 114. Specifically, the privacy panels 133 include a rigid rectangular frame 134 which is formed of rigid rails, which in this case preferably do not flex. The rigid frame 134 is covered by a covering 120-1 which is formed substantially the same as the covering 128 except that the frame 134 has a greater thickness than the frame 119 and thus, the covering 120-1 is formed to accommodate this greater thickness.

Similar to the covering 120, the covering 120-1 includes a solid peripheral portion 125-1 and a mesh-like central portion 127-1. A closure 122-1 is provided at one end thereof and the rigid frame 134 is tight fittingly received within the interior compartment of the covering 120-1. Further, the frame 134 includes outward opening channels which receive a spline to secure the covering 120-1 therein and tighten the covering 20-1.

To secure the privacy panel 133 in place, generally H-shaped clamp brackets 136 join the lower edge of the privacy panel 133 to the upper edge of the wall 131. In particular, the clamp brackets 136 are formed from separate halves 137 which are fastened together by suitable fasteners 138. The privacy panel 133 and knee wall 131 are received in respective upper and lower slots 139, which said slots 139 are dimensioned to grip or clamp onto the respective panel when secured together by the fasteners 138.

With the modesty panel 114 and privacy panel 133, a relatively uncomplicated panel construction is provided which provides a soft surface when contacted by a user but still provides the desired privacy.

The above-described desk arrangement 10 thereby provides further improvements and advantages over prior systems formed of unconnected furniture components. In particular, the first and second desk units 11 and 12 of the desk arrangement 10 can be pushed together for use as a continuous single unit, and can also be separated and move relative to each other to a variety of configurations while remaining interconnected. Further, the desk arrangement 10 has an increased cable management capability.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A desk arrangement comprising:

a first desk unit which includes a first worksurface:

a second desk unit which includes a support structure movably supported on a floor and a second worksurface that is supported by said support structure, said second desk unit being movable between a closed position wherein said second desk unit is disposed adjacent to said first desk unit and an open position wherein said second desk unit is spaced apart from said first desk unit, said first and second worksurfaces defining adjacent worksurface edges which are complementary to each other such that said first and second worksurfaces fit closely next to each other and define a substantially coplanar worksurface area extending therebetween; and an intermediate worksurface having first and second connectors, said first and second connectors being connected to said first and second desk units respectively such that said intermediate worksurface is disposed below and extends between said first and second worksurfaces, at least one of said first and second connectors defining a first slide connection along which said intermediate worksurface slides along a first slide path relative to said respective desk unit, said first slide connection permitting sliding of said intermediate worksurface between a storage position and a use position wherein said intermediate worksurface is disposed in said storage position when said first and second desk units are in said closed position and is disposed in said use position when said first and second desk units are spaced apart in said open position, at least a central region of said intermediate worksurface being vertically exposed between said first and second desk units when in said use position.

2. A desk arrangement according to claim 1, wherein said complementary worksurface edges extend in a longitudinal direction, said first slide path being oriented transverse to said longitudinal direction.

3. A desk arrangement according to claim 1, wherein said first and second desk units are generally elongate so as to extend in longitudinal directions oriented transverse to each other, said first slide path being oriented transverse to said longitudinal direction of said respective desk unit.

4. A desk arrangement according to claim 3, wherein said first and second connectors are disposed on opposite ends of said intermediate worksurface, the other of said first and second connectors defining a second slide connection along which one of said ends of said intermediate worksurface slides along a second slide path.

5. A desk arrangement according to claim 1, which includes cabling for power and/or communications, said cabling being supported on a lower surface of said intermediate worksurface to span the distance between said first and second desk units when in said open position.

6. A desk arrangement according to claim 5, wherein said second desk unit has a receptacle mounted thereon, said cabling being connected to said receptacle.

7. A desk arrangement according to claim 6, wherein said second desk unit includes a modesty panel which is mounted to said support structure thereof and faces outwardly, said receptacle being disposed inwardly of said modesty panel and said modesty panel being spaced downwardly from said second worksurface to permit access to said receptacle.

8. A desk arrangement according to claim 1, wherein said first desk unit is stationary and said second desk unit includes casters on said support structure to facilitate sliding movement of said second desk unit, said second connector defining a pivot connection which allows swinging of said second desk unit about a vertical pivot axis to permit repositioning of said second desk unit relative to said first desk unit when in said open position.

9. A desk arrangement comprising:

a first desk unit which includes a horizontally enlarged first worksurface, said first worksurface including an edge section which extends longitudinally in a first longitudinal direction;

a second desk unit which defines a horizontally enlarged second worksurface, said second desk unit extending longitudinally in a second longitudinal direction and including an edge section at one end thereof said second desk unit being movable between an outer position wherein said edge sections of said first and second desk units are spaced from each other and an inner position wherein said second desk unit is moved toward said first desk unit; and an intermediate worksurface having first and second connectors disposed on opposite ends thereof, said first and second connectors being connected respectively to said first and second desk units wherein said intermediate worksurface is stored below said first and second worksurfaces in a storage position when said second desk unit is in said inner position, said second connector defining a pivot connection with said second desk unit to permit relative pivoting movement between said intermediate worksurface and said second desk unit, and said first connector defining a first slide path along which said respective end of said intermediate worksurface is slidable relative to said first desk unit and, said first slide path being oriented transverse relative to said edge section of said first worksurface such that said intermediate worksurface generally slides between said storage position wherein said intermediate worksurface moves inwardly into a storage area disposed below said first worksurface and an open position wherein said intermediate worksurface is pulled outwardly from the storage area by movement of said second desk unit and exposed vertically.

10. A desk arrangement according to claim 9, wherein said intermediate worksurface is pivotally connected to said first connector to permit both sliding and pivoting movement between said intermediate worksurface and said first worksurface.

11. A desk arrangement according to claim 9, wherein said second connector defines a second slide path along which said respective end of said intermediate worksurface is slidable relative to said second desk unit, said intermediate worksurface being pivotally connected to said second connector to define said pivot connection.

12. A desk arrangement according to claim 9, wherein said first desk unit and second desk units are freestanding.

13. A desk arrangement according to claim 12, wherein said intermediate worksurface is oriented transverse relative to said edge sections of said first and second desk units when in said storage position.

14. A desk arrangement according to claim 12, wherein said first and second worksurfaces are substantially coplanar and said intermediate worksurface is disposed below said first and second worksurfaces.

15. A reconfigurable furniture arrangement comprising:

a first furniture unit disposed on one side of a work area, said first furniture unit being accessible from said work area;

a second furniture unit having a support structure and an upward facing worksurface which is supported on said support structure and is accessible from a second side of said work area, said second furniture unit being a freestanding unit which is movable to permit movement sidewardly toward and away from said first furniture unit;

at least one of said first and second furniture units including a worksurface storage area which has an open side that opens sidewardly toward the other of said first and second furniture units; and an upward facing intermediate worksurface which has opposite ends supported by said first and second furniture units respectively, one of said ends of said intermediate worksurface being received within said storage area and movably supported on the one furniture unit by a first connector which defines an elongate path that extends inwardly away from said open side, the other of said ends of said intermediate worksurface being pivotally supported on the other of said first and second furniture units by a second connector which defines a pivot connection that permits pivoting movement of said second furniture unit relative to said first furniture unit about a vertical first pivot axis, said intermediate worksurface being movable along said elongate path inwardly to a stored position within said storage space and outwardly to an extended position when said second furniture unit is moved respectively toward and away from said first furniture unit, said intermediate worksurface being accessible from said work area when in said extended position.

16. A furniture arrangement according to claim 15, wherein said first connector further defines a pivot connection which permits pivoting of said intermediate worksurface about a vertical second pivot axis.

17. A furniture arrangement according to claim 16, wherein said second connector also defines a respective elongate path along which said intermediate worksurface moves.

18. A furniture arrangement according to claim 15, wherein said intermediate worksurface is disposed below said worksurface of said second furniture unit and is completely enclosed by said first and second furniture units when in said stored position.

19. A furniture arrangement according to claim 18, wherein said first and second furniture units are movable together in abutting relation.

20. A furniture arrangement according to claim 19, wherein said first furniture unit includes a respective worksurface which abuts against said worksurface of said second furniture unit when in abutting relation to define a continuous worksurface extending across said first and second furniture units.

* * * * *